US006733171B2

(12) United States Patent
Schöb

(10) Patent No.: US 6,733,171 B2
(45) Date of Patent: May 11, 2004

(54) MAGNETIC STIRRING APPARATUS AND AN AGITATING DEVICE

(75) Inventor: Reto Schöb, Volketswil (CH)

(73) Assignee: Levitronix LLC, Waltham, MA (US)

( * ) Notice: Subject to any disclaimer, the term of this patent is extended or adjusted under 35 U.S.C. 154(b) by 0 days.

(21) Appl. No.: 09/912,695

(22) Filed: Jul. 23, 2001

(65) Prior Publication Data

US 2003/0053371 A1 Mar. 20, 2003

(30) Foreign Application Priority Data

Sep. 13, 2000 (EP) ..... 00810822

(51) Int. Cl.[7] ..... B01F 13/08
(52) U.S. Cl. ..... 366/273; 435/302.1
(58) Field of Search ..... 366/273, 274, 366/331; 435/302.1

(56) References Cited

U.S. PATENT DOCUMENTS 2,958,517 A * 11/1960 Harker et al.
4,450,076 A * 5/1984 Medicus et al.
4,465,377 A 8/1984 de Bruyne
4,498,785 A * 2/1985 de Bruyne
4,534,656 A 8/1985 de Bruyne
4,759,635 A * 7/1988 Mac Michael et al.
4,760,028 A * 7/1988 de Brune et al.
4,960,521 A * 10/1990 Keller

FOREIGN PATENT DOCUMENTS

EP 0 124 970 A2 * 11/1984
EP 0259002 A2 3/1988
FR 2 449 473 A * 10/1980
JP 58-119329 A * 7/1983
JP 06-261747 A * 9/1994

OTHER PUBLICATIONS

Patent Abstracts of Japan, vol. 018, No. 662 (C–1287), Dec. 14, 1994 & JP 06 261747 A (Hitachi Ltd), Sep. 20, 1994, Abstract.

* cited by examiner

*Primary Examiner*—Tony G. Soohoo
*Assistant Examiner*—David Sorkin
(74) *Attorney, Agent, or Firm*—William Michael Hynes; Townsend and Townsend and Crew LLP

(57) ABSTRACT

The magnetic stirring apparatus (1) comprises an agitator (1*a*), at least one permanent magnet (1*d*, 1*e*) and a float body (1*f*), which are connected to one another.

13 Claims, 20 Drawing Sheets

MAGNETIC STIRRING APPARATUS AND AN AGITATING DEVICE

BACKGROUND OF THE INVENTION

The invention relates to a magnetic stirring apparatus. The invention further relates to an agitating device activated by the magnetic stirring apparatus.

Bar magnets are known which are used to stir liquids by adding the bar magnet to a container containing liquid and setting the container on a rotating magnetic field so that the bar magnet is set into rotation.

It is disadvantageous with such bar magnets that they rest on the bottom of the container and thus only generate a limited stirring effect. The frictional forces occurring between the bar magnet and the bottom can moreover effect abrasion or destroy parts, such as living cells, contained in the liquid.

SUMMARY OF THE INVENTION

It is an object of the present invention to propose a more advantageous magnetic stirring apparatus and a more advantageous agitating device.

The object is satisfied in particular by a magnetic stirring apparatus comprising an agitator, a permanent magnet and a float body, which are connected to one another.

An important aspect of the invention comprises the magnetic stirring apparatus being formed such that the agitator is arranged spaced from the bottom of the container so that the agitator no longer slidingly rotates on the bottom during stirring.

In a preferred embodiment, the magnetic stirring apparatus is formed in an elongate, essentially bar-like manner, with the agitator being arranged in the region of the first end section and a float body being arranged in the region of the second end section. In a particularly advantageous embodiment, the end of the first end section is formed as a tip. This magnetic stirring apparatus is put into a container containing liquid, with the magnetic stirring apparatus being held in an essentially vertically extending orientation and being stabilized against tilting by the buoyancy forces acting on the float body. The float body thus effects a hydrodynamic stabilization of the magnetic stirring apparatus against tilting and thus stabilizes the magnetic stirring apparatus with respect to two degrees of freedom.

A device is arranged beneath the bottom of the container which allows a magnetic rotating field to be generated. This device is formed in a preferred embodiment as a magnetic coupling comprising a rotating permanent magnet. This permanent magnet acts on the permanent magnets arranged in the agitator. The position of the agitator and thus the position of the magnetic stirring apparatus is determined with respect to three degrees of freedom, namely in the x and y directions and with respect to the rotation, by the magnetic coupling formed in this way. This is only stabilized with respect to a downward movement in the vertical direction, that is, in the direction of extension of the magnetic stirring apparatus, by the tip which forms a toe bearing together with the bottom of the container. Together with the downward acting magnetic force of the magnetic coupling, the vertical degree of freedom (z direction) is also stabilized.

The magnetic stirring apparatus is thus stabilized with respect to six degrees of freedom. The known bar magnet initially mentioned is only stabilized with respect to four degrees of freedom, namely in the x and y directions, with respect to rotation, since it is on the bottom of the container, and with respect to a downward movement. The magnetic stirring apparatus in accordance with the invention thus has the advantage that it is stabilized with respect to more degrees of freedom, which allows the agitator to be arranged spaced from the bottom of the container.

In a further advantageous embodiment, the magnetic stirring apparatus is arranged in a floating manner in the liquid of the container, with the magnetic stirring apparatus being drivable via a magnetic field arranged outside the container. The rotating magnetic field required for the drive can be generated with the aid of electromagnetic coils or with pivoted magnets, in particular with pivoted permanent magnets which form a magnetic coupling with the magnetic stirring apparatus. Moreover, the position of the magnetic stirring apparatus is influenced in an advantageous embodiment using the permanent magnets by these permanent magnets forming part of a passive magnetic bearing. The one part of the passive magnetic bearing is arranged outside the container and exerts a stabilizing effect on the position of the magnetic stirring apparatus located inside the container.

The object is further satisfied with an agitator comprising a magnetic stirring apparatus having one or more permanent magnets and a float body and comprising a magnetic drive device, with the drive device and the permanent magnets of the magnetic stirring apparatus being arranged and formed in a mutually matched manner such that they form a magnetic coupling.

The invention is described in the following by way of several embodiments.

DESCRIPTION OF THE PREFERRED EMBODIMENTS

Figure 1A:
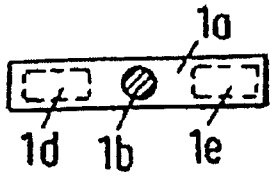
FIG. 1*a* shows a detailed view of the agitator.
Figure 1:
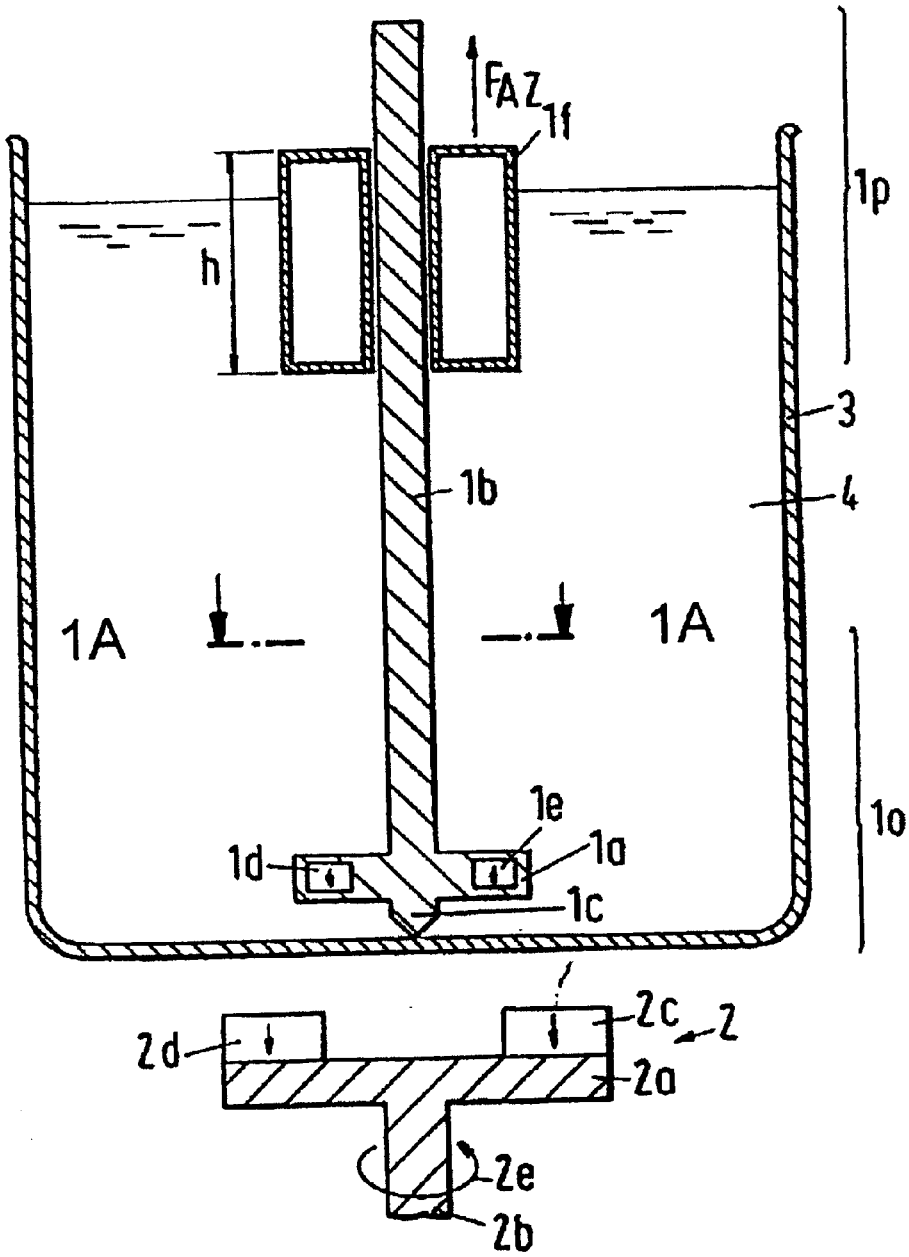
FIG. 1 is a longitudinal section through an agitator having a magnetic stirring apparatus resting in the container.

FIG. 1 shows, in a longitudinal section, a magnetic stirring apparatus 1 comprising an agitator 1*a*, a bar 1*b* and a float body 1*f* which are connected to one another. Two permanent magnets 1*d*, 1*e* are arranged symmetrically with respect to the bar 1*b* inside the agitator 1*a*, as shown in FIG. 1*a* in the section 1*a*—1*a* of FIG. 1. The bar 1*b* opens downwardly into a tip 1*c*, which forms a toe bearing together with the bottom of the container 3. The agitator 1*a* is arranged slightly spaced from the tip 1*c* in the first end section 1*o* of the bar 1*b* so that the agitator does not touch the bottom of the container 3. The float body 1*f* is arranged in the second end section 1*p*. The float body if is displaccable in the direction of extension of the bar 1*b* and can be fixedly connected to the bar 1*b* by a fastening means (not shown) such as a screw. The magnetic stirring apparatus 1 is held in a substantially vertical position by the liquid 4 located inside the container 3 and the buoyancy force FAZ thus effected on the float body 1*f*. The float body if thus stabilizes the magnetic stirring apparatus 1 hydrostatically against tilting so that the position of the magnetic stirring apparatus is thereby hydrostatically stabilized with respect to two degrees of freedom.

A drive device 2 is arranged beneath the container 3. The drive device 2 comprises a plate 2*a* and an axle 2*b* pivoted in the direction of rotation 2*e*, with two permanent magnets 2*c*, 2*d* being fixedly connected to the plate 2*a*. The permanent magnets 1*d*, 1*e* of the magnetic stirring apparatus 1 and the permanent magnets 2*c*, 2*d* of the drive apparatus 2 are arranged and formed in a mutually matched manner such that they jointly form a magnetic coupling in order to drive the magnetic stirring apparatus 1 in the direction of rotation 2*e*. This magnetic coupling stabilizes the magnetic stirring apparatus 1 with respect to the radial position in the x and y directions and in the direction of rotation so that the magnetic coupling stabilizes the magnetic stirring apparatus 1 with respect to three degrees of freedom.

The magnetic stirring apparatus 1 rises on the toe bearing 1*c* such that the magnetic stirring apparatus 1 is stabilized with respect to a downward movement so that the magnetic stirring apparatus 1 is stabilized with respect to one degree of freedom by the toe bearing and the magnetic force of attraction between the permanent magnets 1*d*, 1*e*, 2*c*, 2*d*. The position of the magnetic stirring apparatus 1 is thus stabilized with respect to six degrees of freedom by the means shown in FIG. 1.

Figure 1B:
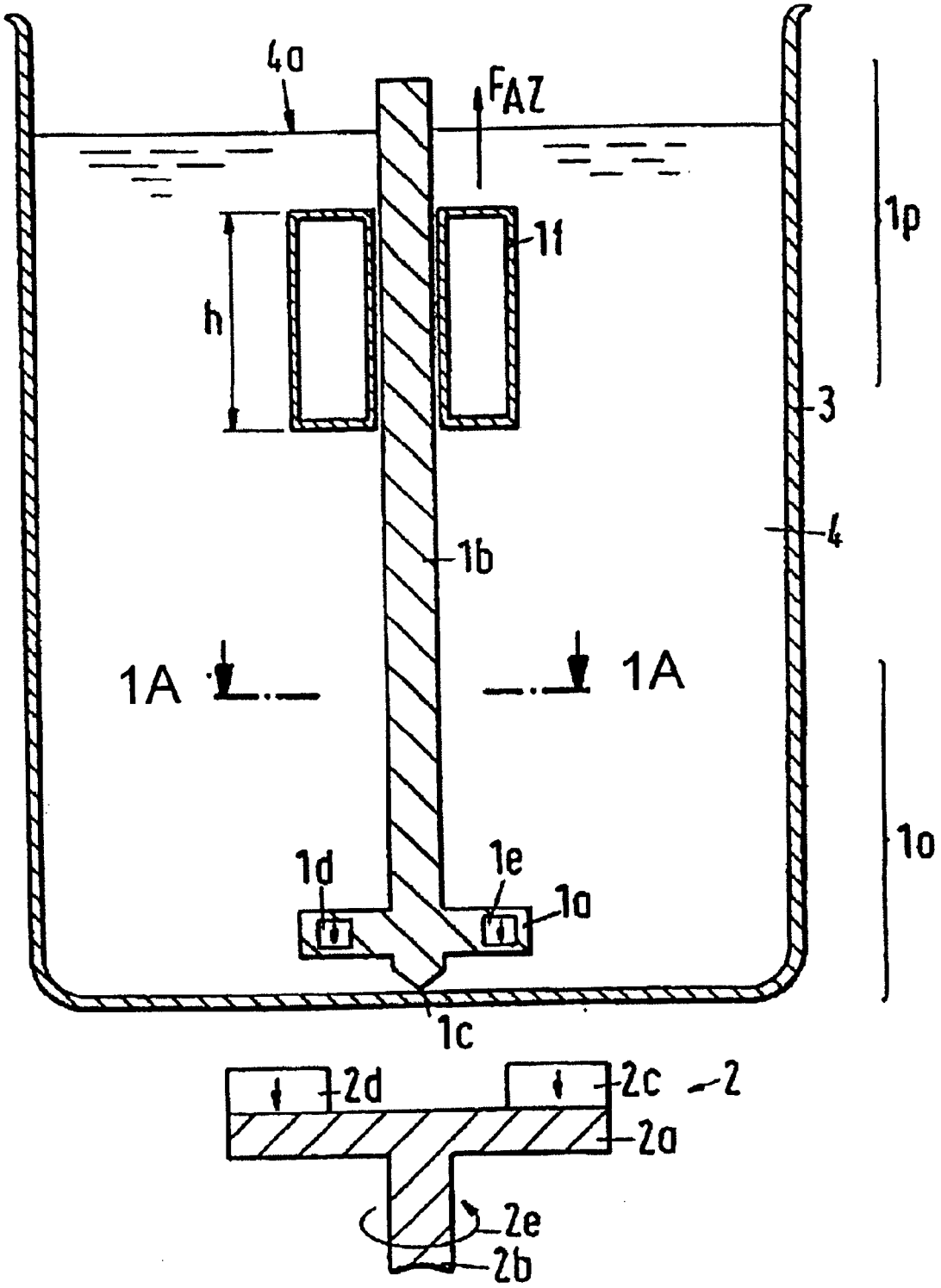
FIG. 1*b* shows a magnetic stirring apparatus having a completely submerged float body.

It is a required condition of the hydrostatic stabilization that the float body 1*f* is at least partially submerged in the liquid or, as shown in FIG. 1*b*, is completely submerged. For the toe bearing 1*c* to rest on the bottom of the container 3, it is necessary for the weight of the magnetic stirring apparatus 1 and the force of attraction effected by the magnetic coupling to be greater than the buoyancy force FAZ effected by the float body.

In distinction to the arrangement shown in FIG. 1, the magnetic stirring apparatus 1 is held in a floating manner in the liquid 4 of the container 3 since the buoyancy force FAZ and the weight of the magnetic stirring apparatus 1 and the magnetic force effected by the magnetic coupling are in a state of equilibrium. For this purpose, the float body 1*f* should be arranged in the corresponding position along the bar 1*b*. To meet this condition, the float body 1*f* is displaccable on the bar 1*b* so that the position of the float body 1*f* is adjustab1e in dependence on the liquid level such that the tip 1*c* of the magnetic stirring apparatus 1 rests on the bottom of the container 3. After the displacement of the float body 1*f*, this is fixedly connected to the bar 1*b*, for example by a screw.

This arrangement has the advantage that the magnetic stirring apparatus 1 is held in a floating and contact-free manner in the container 3.

The space between the agitator 1*a* and the bottom of the container 3 is shown by the dimension z. A force FMZ acts downwardly on the magnetic stirring apparatus 1, with said force FMZ being composed of gravity and the magnetic force of attraction effected by the drive device 2.

Figure 3:
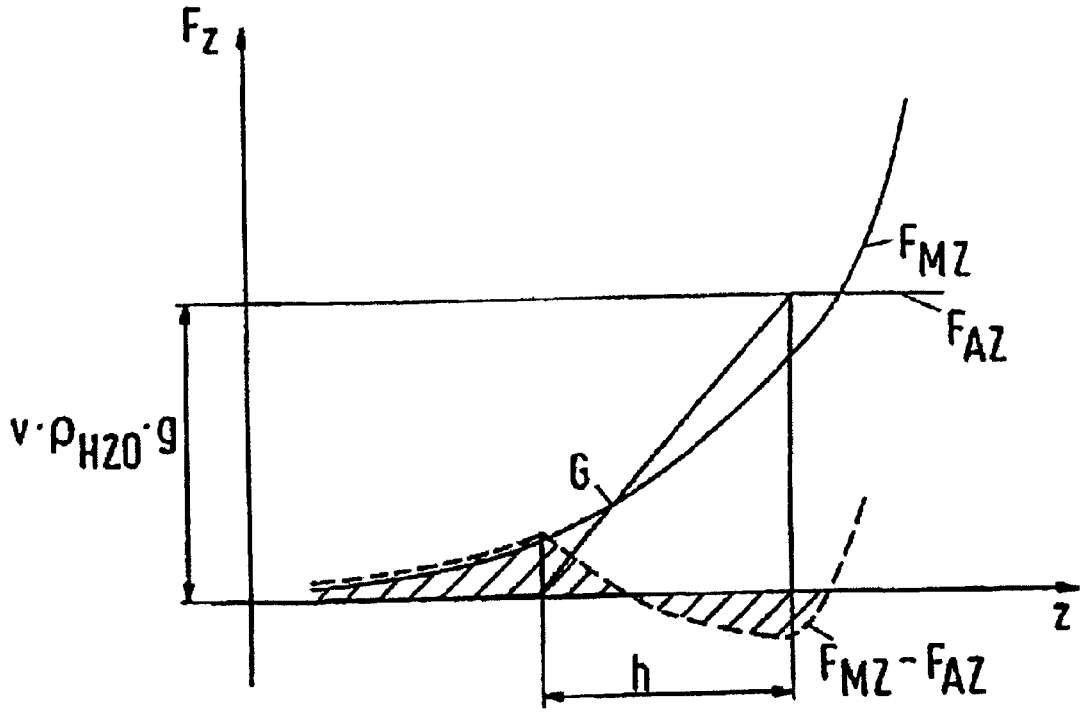
FIG. 3 is a path-force diagram of the magnetic stirring apparatus.

FIG. 3 shows the path-force diagram of the magnetic stirring apparatus 1 floating in the liquid, with the submersion depth z being shown in the abscissa and the force F in the ordinate. The buoyancy force FAZ effected by the float body 1*f* located in a liquid such as water increases in a linear manner as a function of the height h as the submersion depth increases and assumes a constant value after the full submersion of the float body 1*f*. Moreover, the force curve of the force FMZ is shown as a function of the dimension z. A stable state of equilibrium is achieved at the point of intersection G of the two curves FMZ and FAZ. The difference between the force FMZ and the force FAZ is shown as a broken line in FIG. 3. After a malfunction, the system reverts to the stable state of equilibrium G between the two saddle points, limited by the level of the float body. The maximum difference amount between FAZ and FMZ is thus a measure for the robustness of the system. The last degree of freedom of the magnetic stirring device 1, namely the movement vertically upwards, is stabilized by this measure by the buoyancy force together with the magnetic force acting oppositely so that three and one-half degrees of freedom of the magnetic stirring apparatus 1 are magnetically stabilized and two and one-half degrees of freedom of the magnetic stirring apparatus 1 are hydrostatically stabilized.

Figure 4:
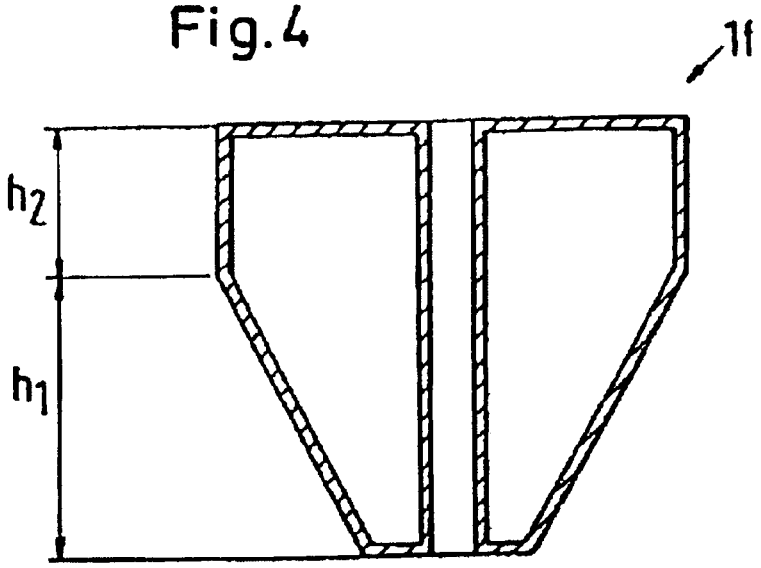
FIG. 4 is a cross-section through a float body.

The buoyancy of the float body 1*f* as a function of the submersion depth is naturally determined by the shape of the float body 1*f* FIG. 4 shows a float body 1*f* in a longitudinal section which is formed in a truncated cone-like shape along a height h1 and in a cylinder-like shape along the height h2.

Figure 5:
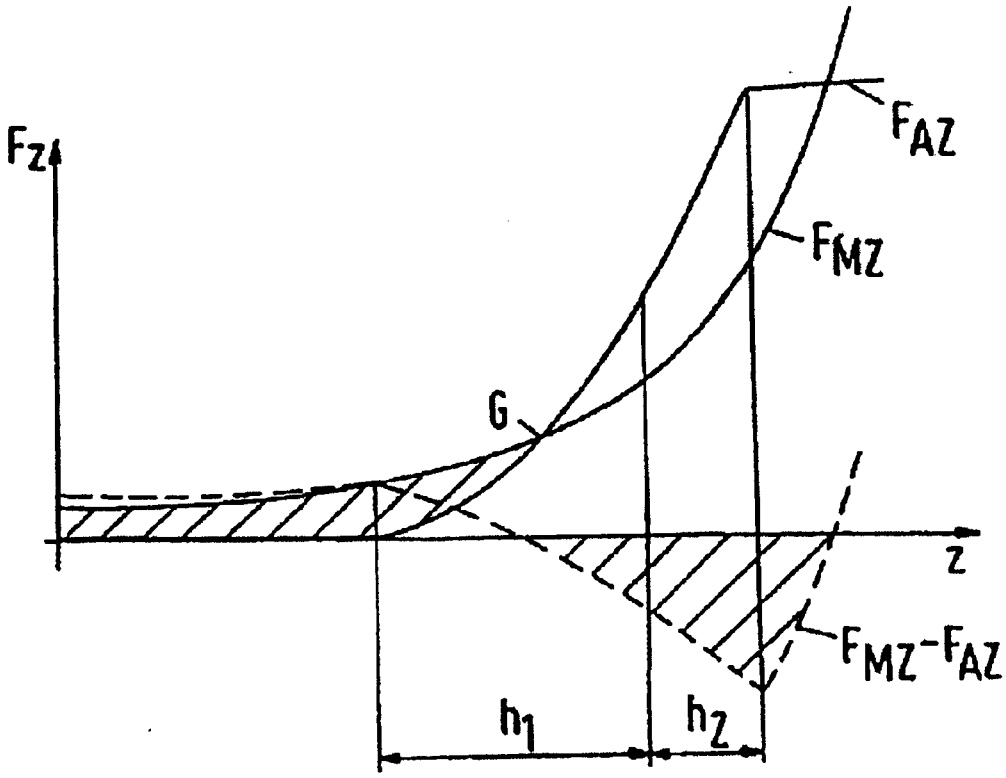
FIG. 5 is a path-force diagram of a further magnetic stirring apparatus.

FIG. 5 shows the path-force diagram of a magnetic stirring apparatus 1 having the float body if shown in FIG. 4. The force FMZ has the same curve as already shown in FIG. 3. The buoyancy force FAZ generated by the float body 1*f* shows an increase in force along the section h1 which is bent, in particular square in extension, whereas the float body 1*f* effects a linear increase in force in the section h2 formed in a cylinder-like shape. When the float body 1*f* is fully submerged, the buoyancy assumes a constant value.

The stable point of equilibrium G is reached, in turn, at the intersection of the two curves FAZ and FMZ. The maximum difference between the forces FMZ and FAZ has a higher (negative) sum in comparison with the curve shown in FIG. 3. Since, as explained in the description of FIG. 3, this is a measure for the robustness of the system, this has the advantage in comparison with FIG. 3 that the magnetic stirring apparatus 1 can be held floating-wise in a more stable manner. When the liquid is stirred, the problem actually occurs due to the operative centrifugal force that the level of liquid falls at the centre of the container 3, while increasing at its rim. This has the consequence that the float 1*f* sinks a little in the container 3, which has the consequence in turn that the distance z is reduced. The magnetic stirring apparatus 1 should also be held in a floating, contact-free manner in the container 3 in this position. To effect a stable behavior, it is therefore of particular importance for the difference between the forces FMZ and FAZ to have a constant course over a fairly long section.

Figure 2:
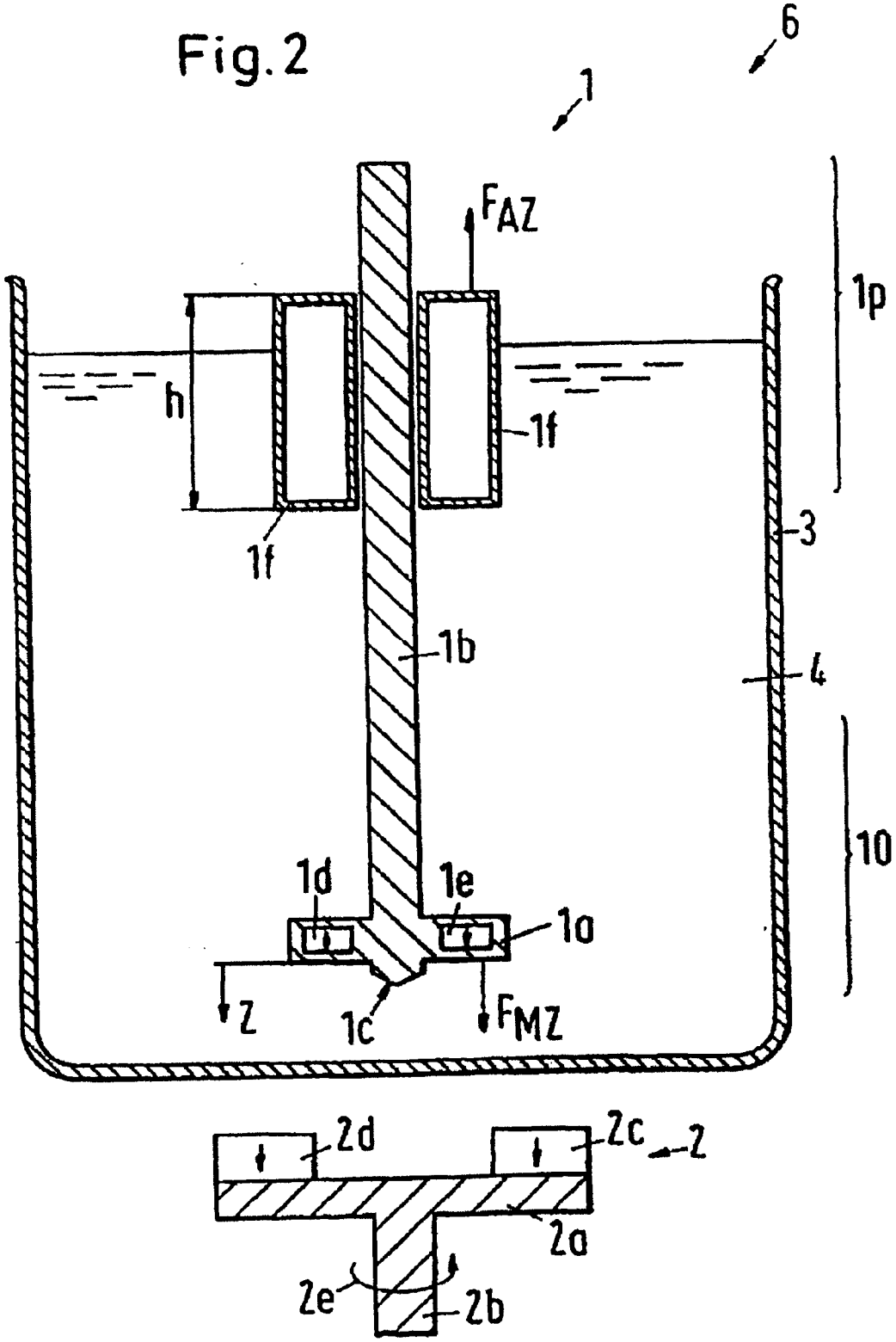
FIG. 2 is a longitudinal section through a first agitating device having a magnetic stirring apparatus.
Figure 6:
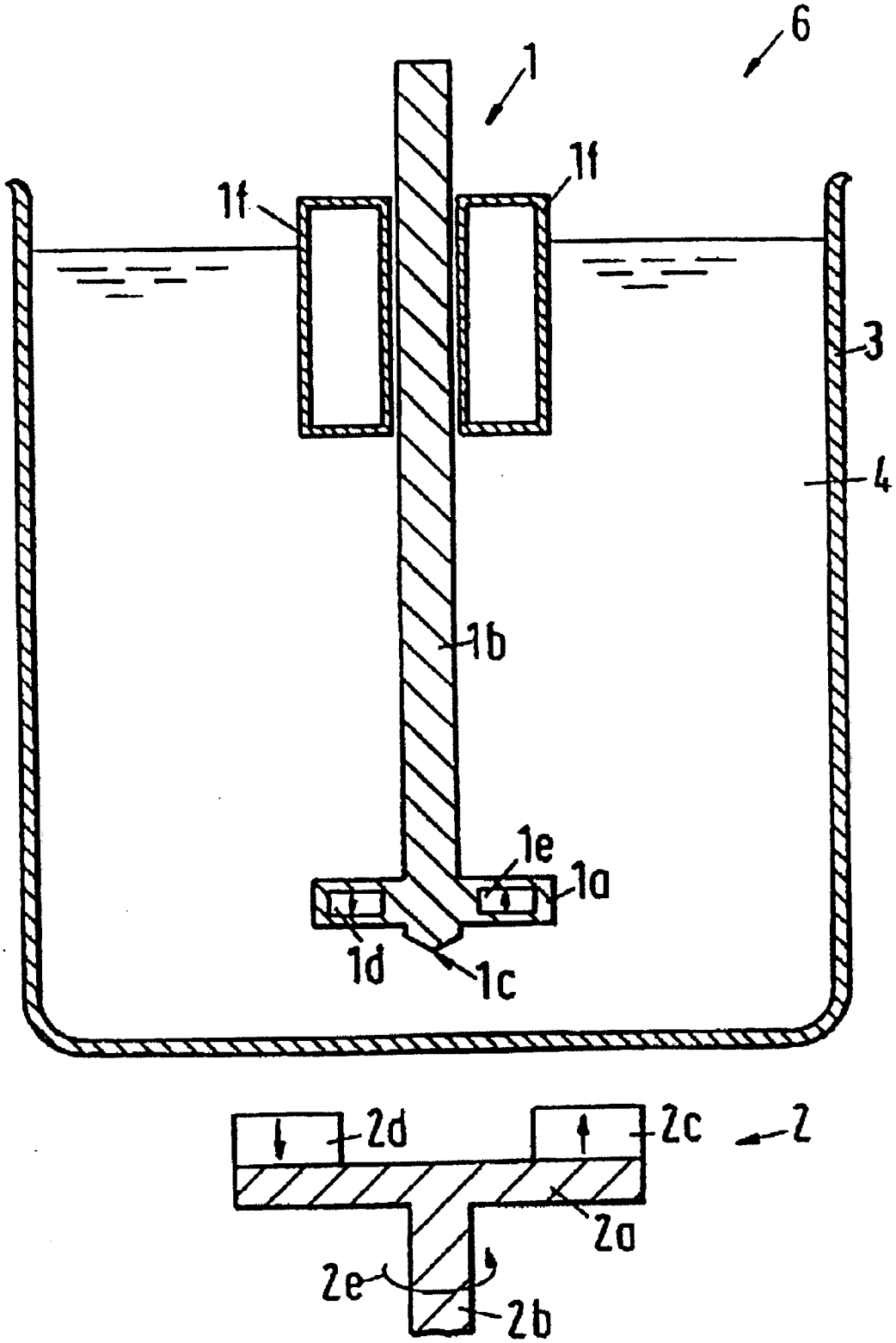
FIG. 6 is a longitudinal section through a further agitating device having a magnetic stirring apparatus.

In distinction to the agitating device 6 shown in FIG. 2, the permanent magnets 1*e*, 2*c* are arranged poled in the opposite direction in the embodiment in accordance with FIG. 6.

Figure 7:
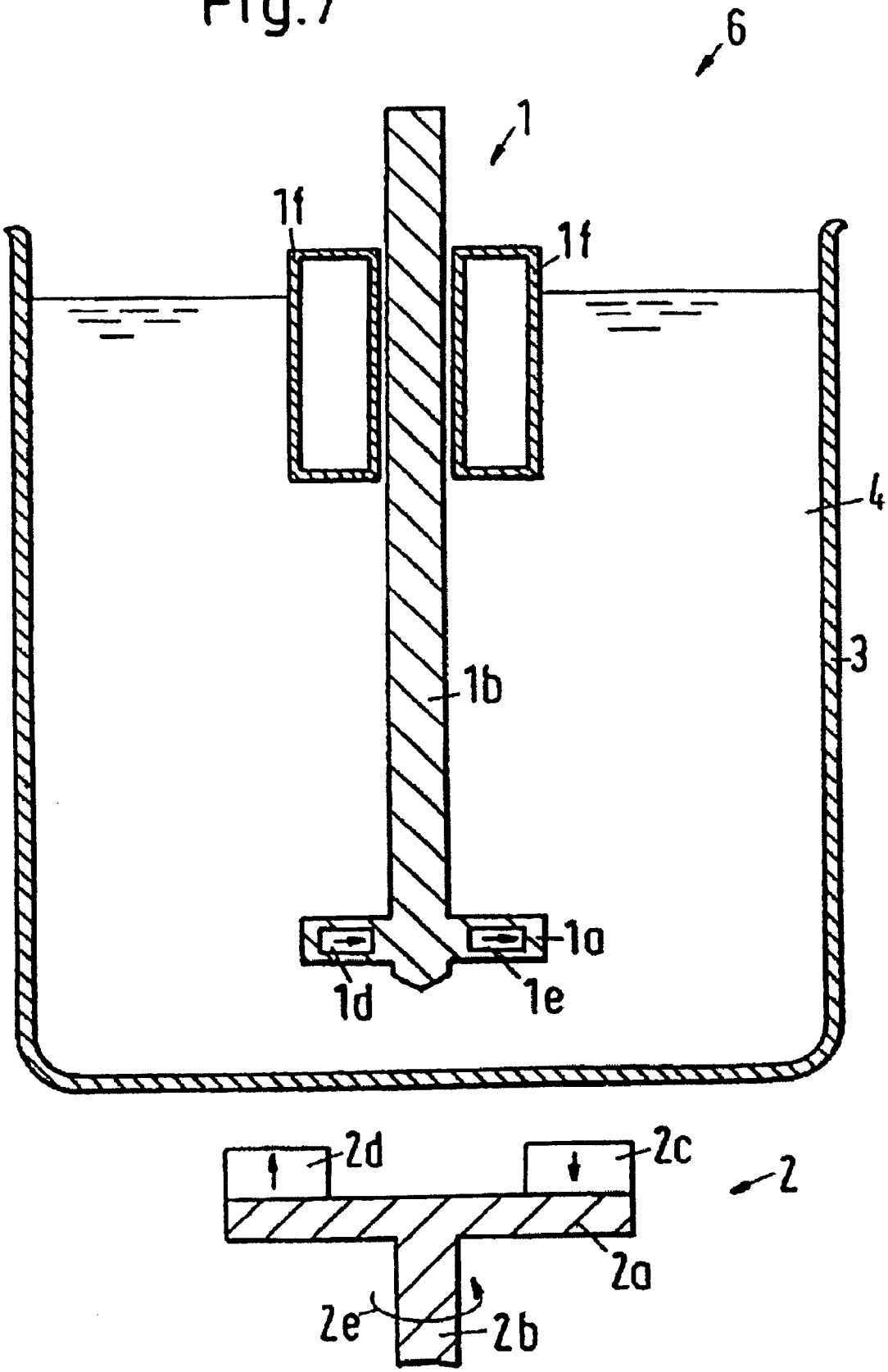
FIG. 7 is a longitudinal section through a further agitating device having a magnetic stirring apparatus.

In distinction to the agitating device 6 shown in FIG. 2, the permanent magnets 1*d*, 1*e* are arranged poled in the horizontal direction, whereas the permanent magnets 2*c*, 2*d* of the drive device 2 are arranged polarized in an opposite manner and in a vertical direction in the embodiment in accordance with FIG. 7.

Figure 8A:
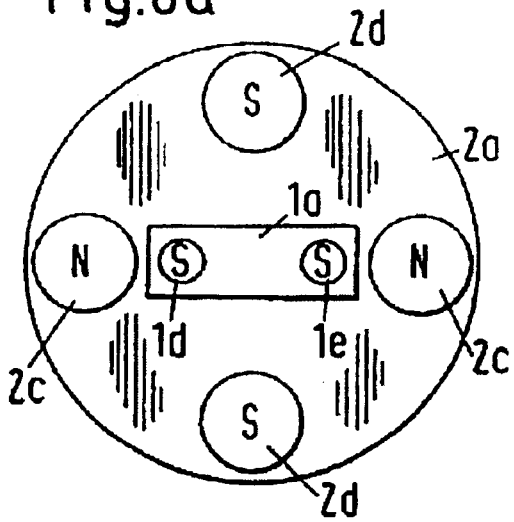
FIGS. 8*a*–8*f* show different arrangements of the permanent magnets of the magnetic stirring apparatus and the agitating device.
Figure 8B:
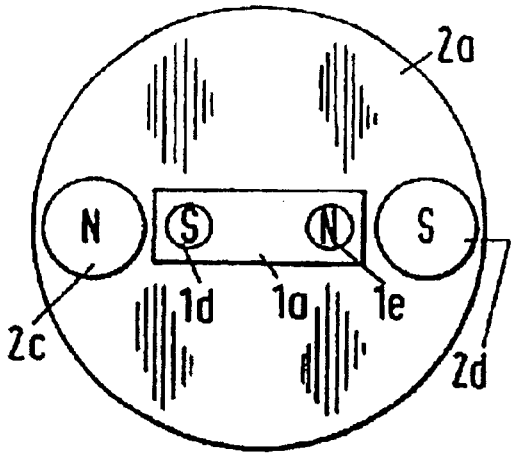
Figure 8C:
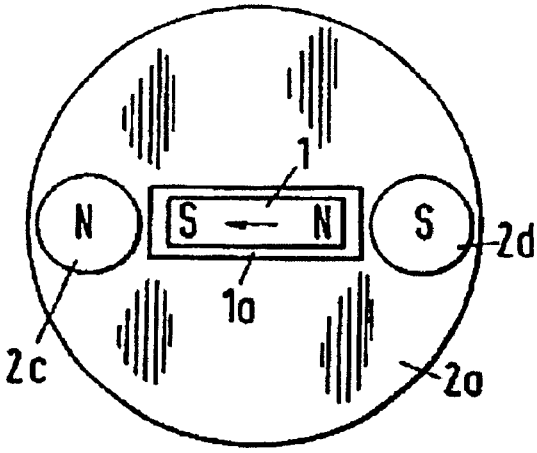
Figure 8D:
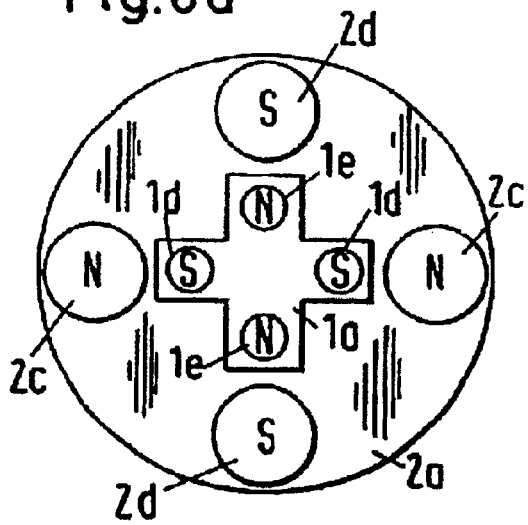
Figure 8E:
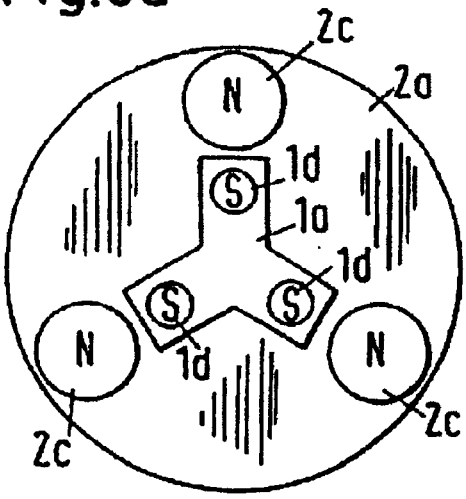
Figure 8F:
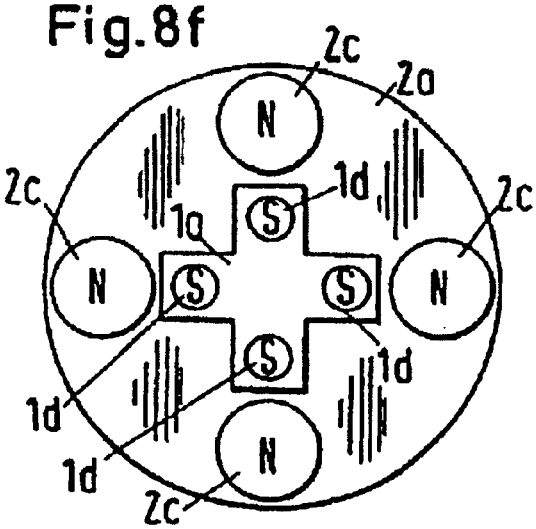

The permanent magnets 1*d*, 1*e* of the agitator 1*a* and the permanent magnets 2, 2*d* of the drive device 2 could be arranged in the most varied ways in order to jointly form a magnetic coupling. Several examples of such arrangements are shown in FIGS. 8*a* to 8*f*. In the plan view of the plate 2*a* of the drive device 2 shown in FIG. 8*a*, the four permanent magnets 2*c*, 2*d* arranged spread in the peripheral direction are shown, with the permanent magnets 2*c* and 2*d* being oppositely poled. FIG. 8*b* shows an arrangement with only two permanent magnets 2*c*, 2*d*. The agitator 1*a* in FIG. 8*c* has a single bar magnet 1*d* The agitator 1*a* in FIG. 8*d* has a cruciform shape, with a permanent magnet 1*d*, 1*e* being arranged at each arm of the cross. The agitator 1*a* in FIG. 8*e* has a star shape, with a permanent magnet 1*d* being arranged at each arm. Three permanent magnets 2*c* are also arranged on the plate 2*a*. The agitator 1*a* in FIG. 8*f* is formed as in FIG. 8*d* as a cross, with the poles of the permanent magnets being aligned in a different orientation in distinction to the embodiment in accordance with FIG. 8*d*. Examples of further arrangements of the permanent magnets are disclosed, for example, in the article "Permanent Magnet Bearings and Couplings, J.P. Yonnet, IEEE Transactions on magnetics, Vol. Mag-17, No. 1, January 1981".

Figure 9:
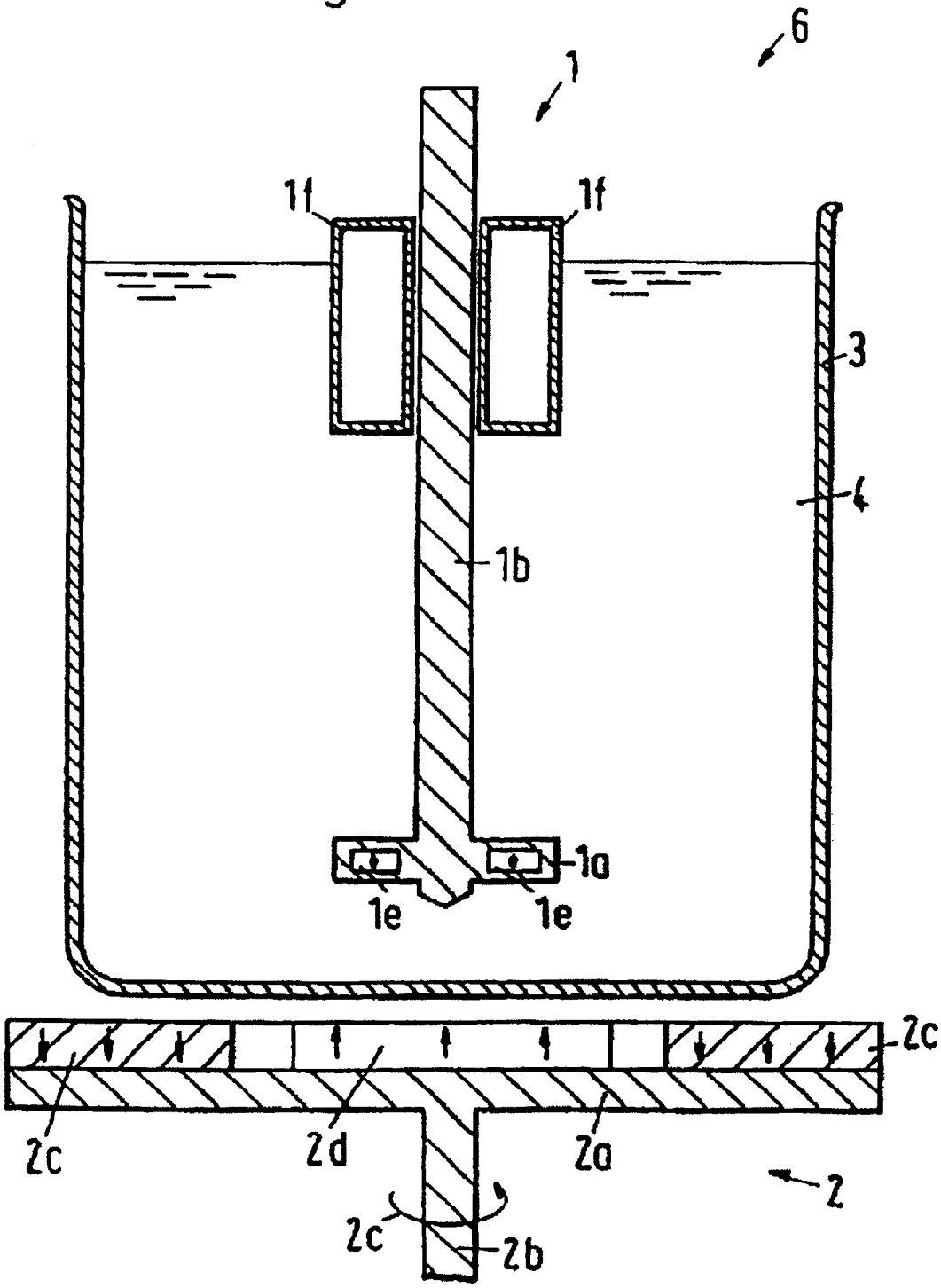
FIG. 9 is a longitudinal section through a further agitating device having a magnetic stirring apparatus.
Figure 10:
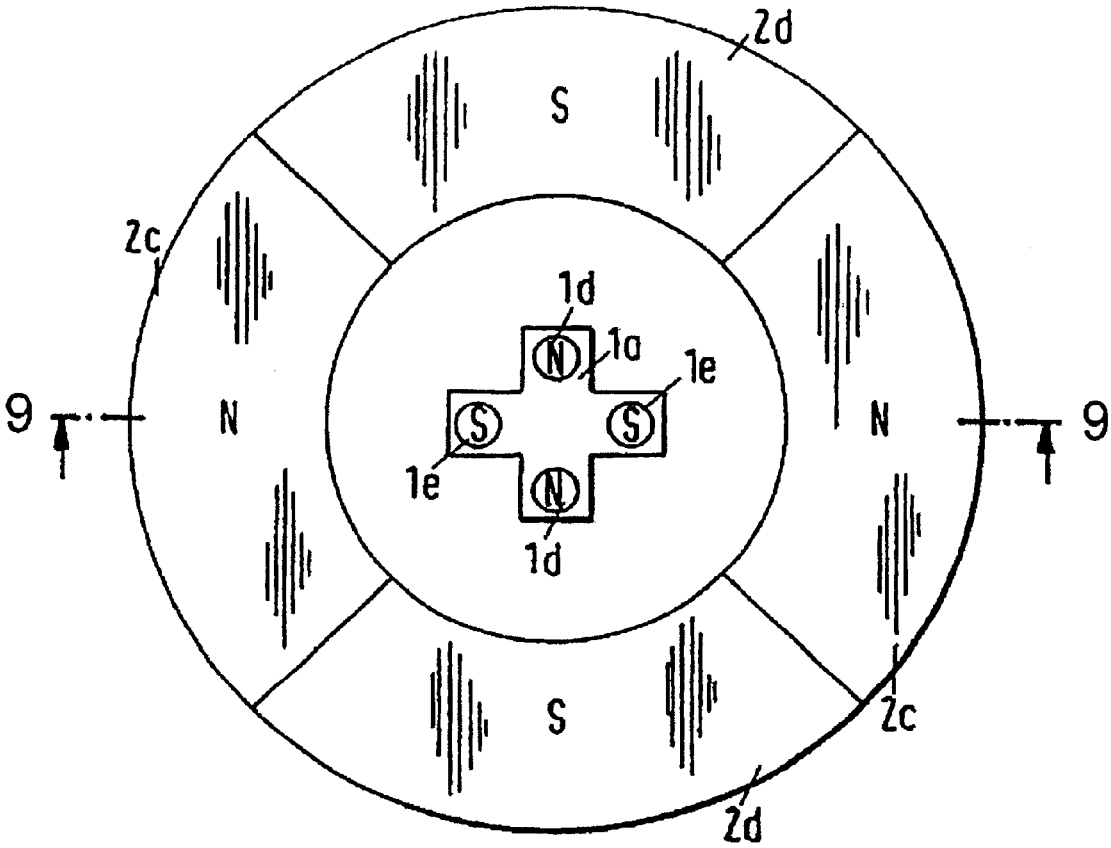
FIG. 10 is a plan view of the drive device shown in FIG. 1.

In distinction to the agitating device 6 shown in FIG. 2, the plate 2*a* of the drive device 2 in accordance with FIG. 9 has a relatively large diameter, with the permanent magnets 2*c*, 2*d* being formed in a circular annular segment shape, as shown in the plan view in accordance with FIG. 10. The agitator 1*a* is formed in cruciform shape, as shown in FIG. 10. One advantage of the arrangement shown in FIG. 9 can be seen in that the magnetic field effected by the drive device 2 only shows a small change in the vertical direction so that a change in position of the magnetic stirring apparatus 1 in a vertical direction towards the magnetic coupling formed by the permanent magnets 2*c*, 2*d*, 1*d*, 1*e* exerts only a slight influence on the coupling behavior.

Figure 11:
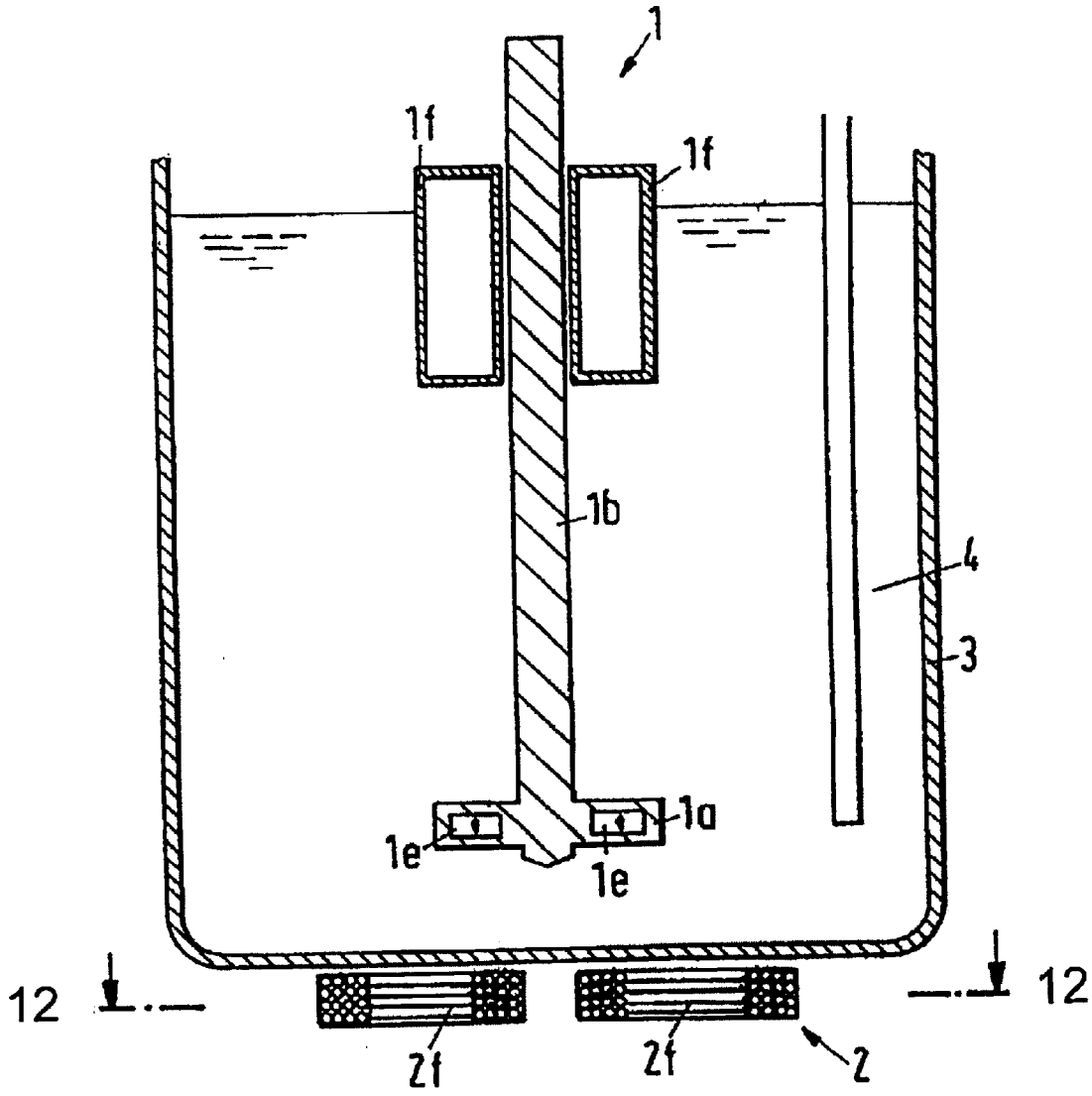
FIG. 11 is a longitudinal section through an agitating device having a magnetic stirring apparatus and provided with electromagnetic coils.
Figure 12:
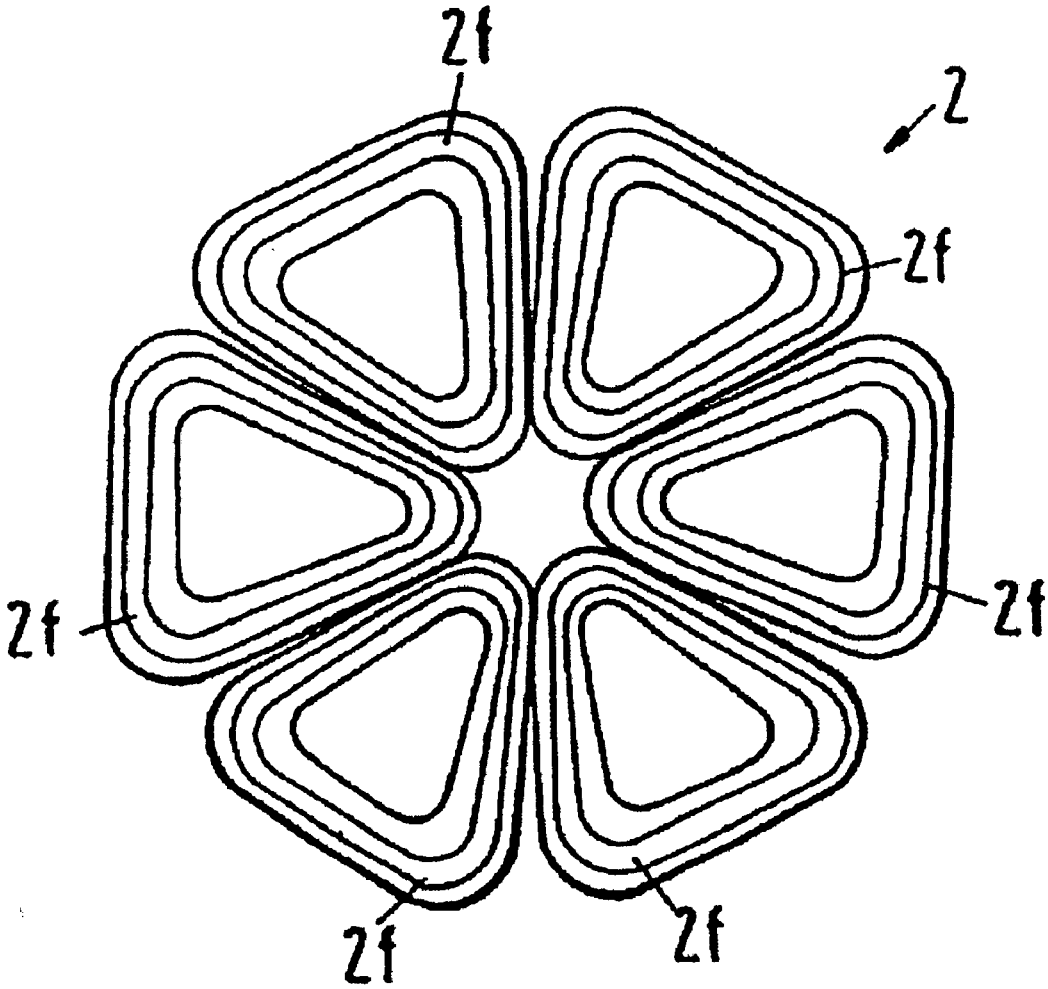
FIG. 12 is a plan view of the electromagnetic coils shown in FIG. 11.

In distinction to the agitating device 6 shown in FIG. 2, in the embodiment shown in FIG. 11, the drive device 2 is formed as a plurality of core bodies 2*f* which, as can be seen from the section along the line 12—12 of FIG. 11 shown in FIG. 12, are arranged at regular spacings in the peripheral direction in order to generate an electromagnetic rotating field by a corresponding selection. These coils have several advantages. Unlike permanent magnets, whose force of attraction becomes greater, the nearer the agitator is, a constant magnetic field can be generated with the coils so that the force of attraction does not increase as the distance to the agitator decreases. Moreover, the magnetic field strength can be regulated via the current of the coils. This exerts a stabilizing influence on the position of the magnetic stirring apparatus.

Figure 13:
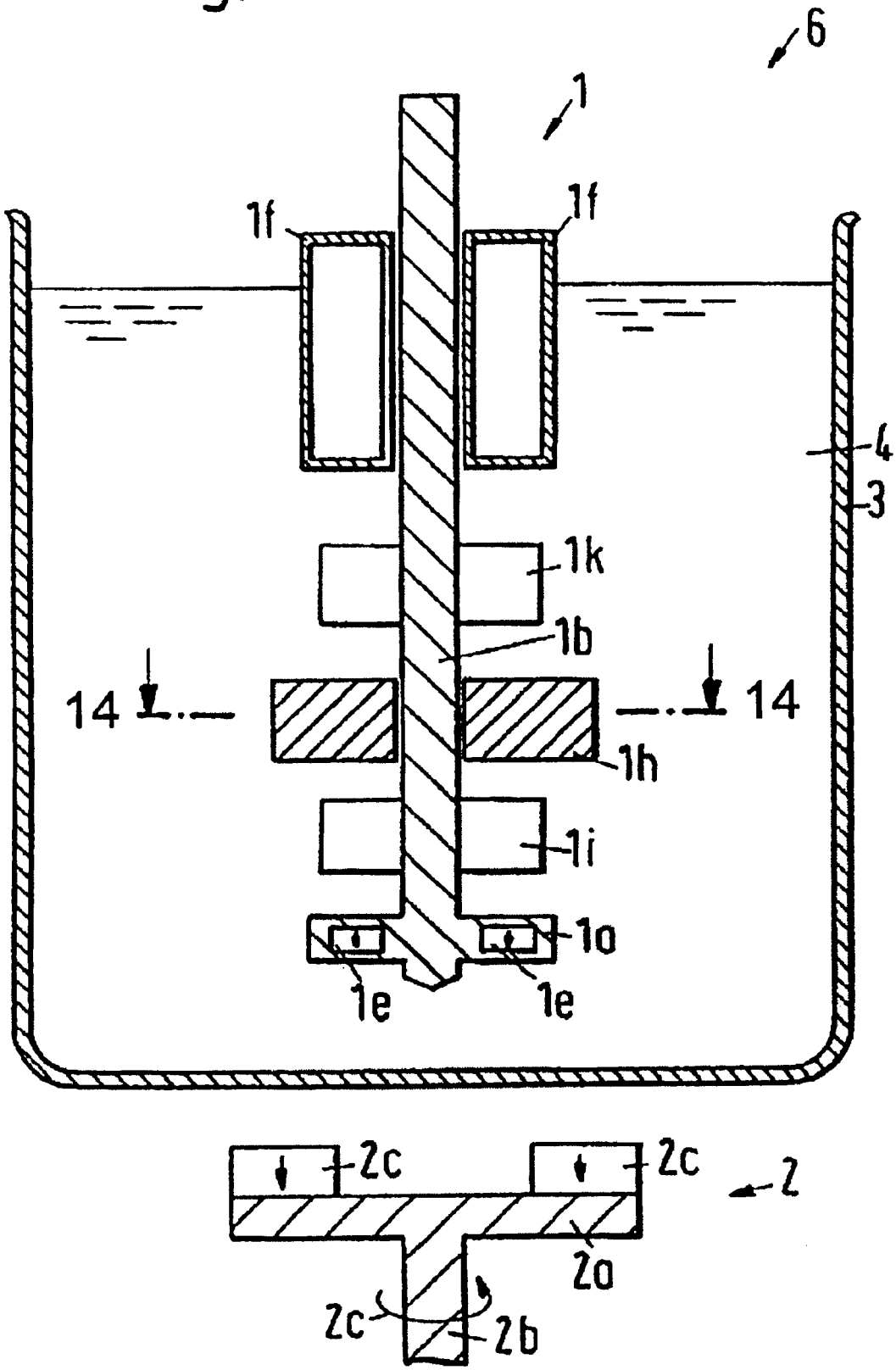
FIG. 13 is a longitudinal section through a further agitating device having a magnetic stirring apparatus.
Figure 14:
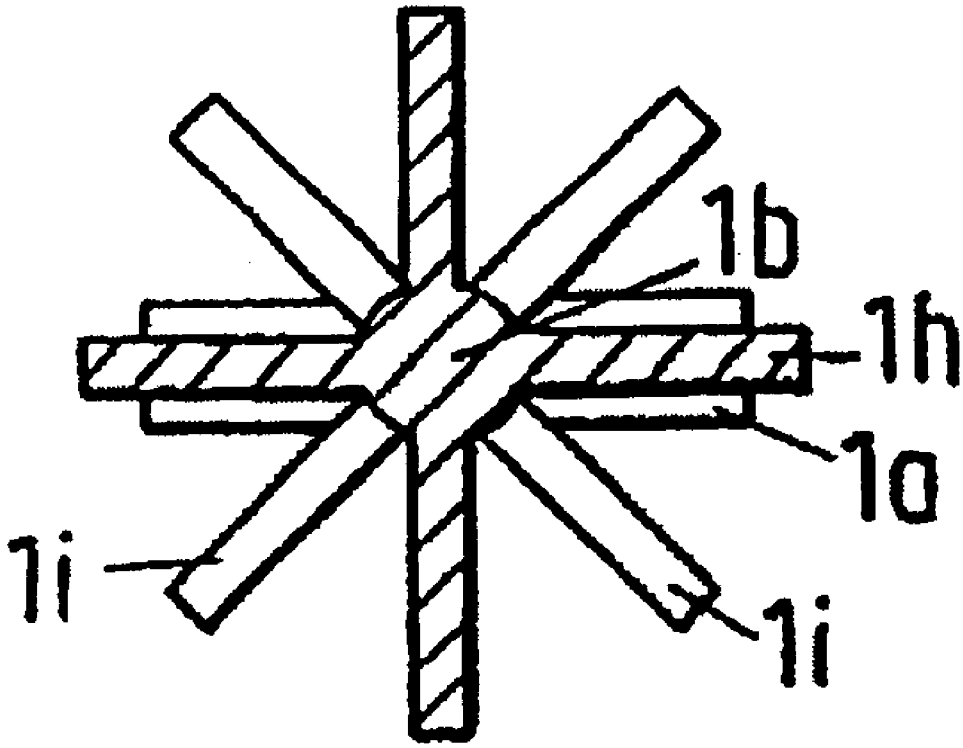
FIG. 14 is a cross-section through a vane arranged at the magnetic stirring apparatus.

In distinction to the agitating device 6 shown in FIG. 2, the magnetic stirring apparatus 1 in the embodiment shown in FIG. 13 has three vanes or blades 1*h*, 1*i*, 1*k* arranged spaced in a vertical direction. This allows the rotational forces of the magnetic stirring apparatus 1 to be transmitted in an even better way to the liquid 4. The section along the line 14—14 of FIG. 13 shown in FIG. 14 shows the vane 1*h* with a cruciform design in section. Moreover, the cruciform vane arranged beneath it and the agitator arranged at the very bottom are shown.

Figure 15:
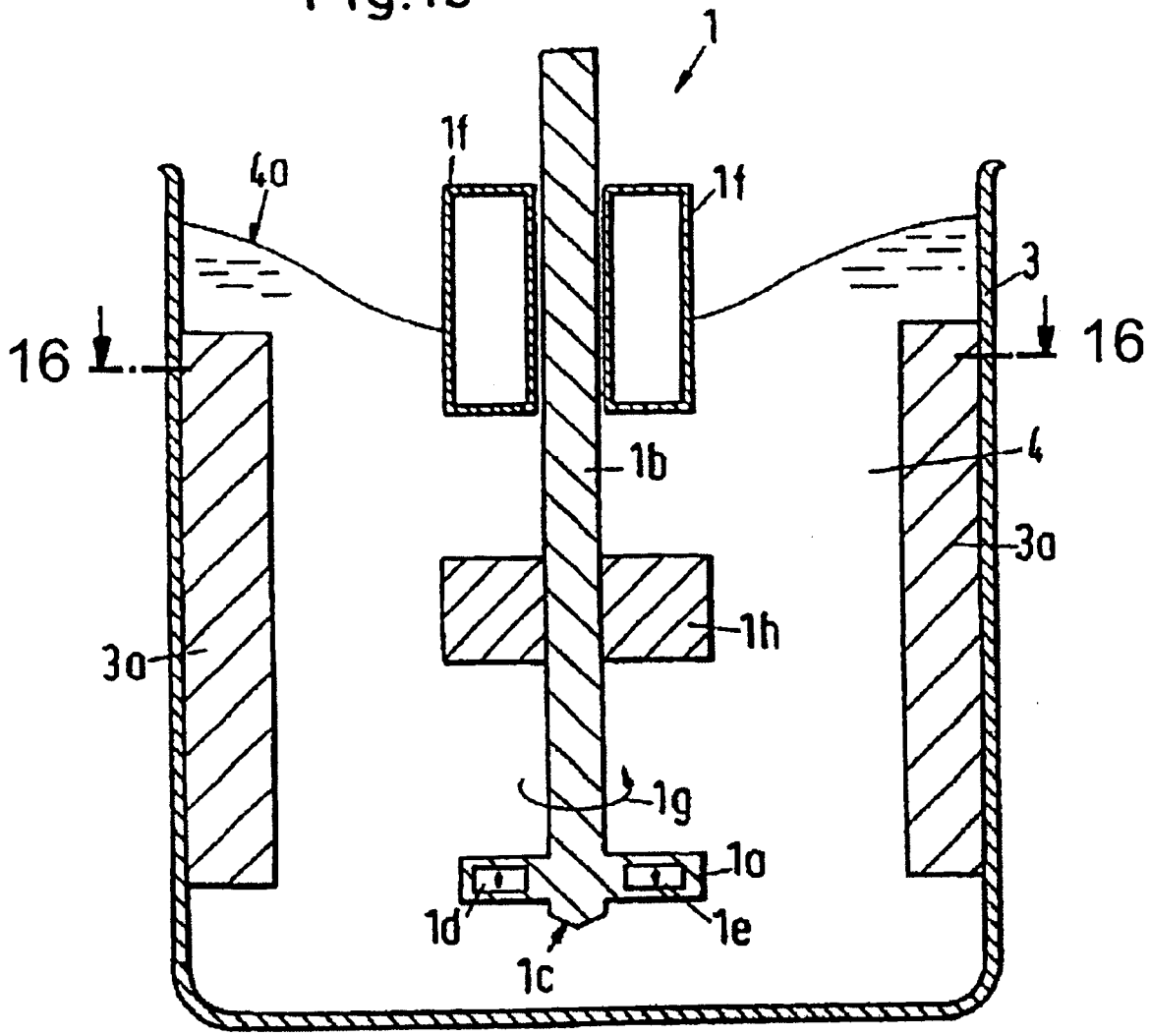
FIG. 15 is a longitudinal section through a further agitating device having a magnetic stirring apparatus.
Figure 16:
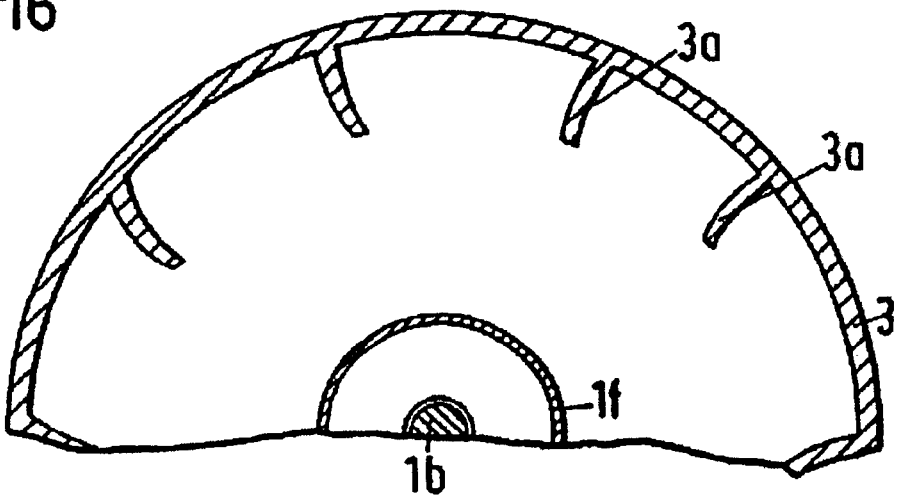
FIG. 16 is a cross-section through the container in accordance with FIG. 15, along the intersection line 16—16.

In distinction to the agitating device 6 shown in FIG. 2, the magnetic stirring apparatus 1 shown in FIG. 15 has an additional vane 1*h* which is fixedly connected to the bar 1*b*. This vane 1*h* serves the better transmission of the rotational forces acting on the magnetic stirring apparatus to the liquid 4. The stirring of the liquid 4 effects an increase of the liquid level 4*a* at the rim of the container 3, whereas the liquid level 4*a* falls at the center, which has the consequence that the magnetic stirring apparatus 1 sinks. The change in the liquid level 4*a* or the rotation speed of the liquid can be reduced in the container 3 by a plurality of radially inwardly projecting rotation brakes 3*a* being arranged at the inside wall of the container 3, as shown in FIG. 16 along the section 16—16 of FIG 5.

Figure 17:
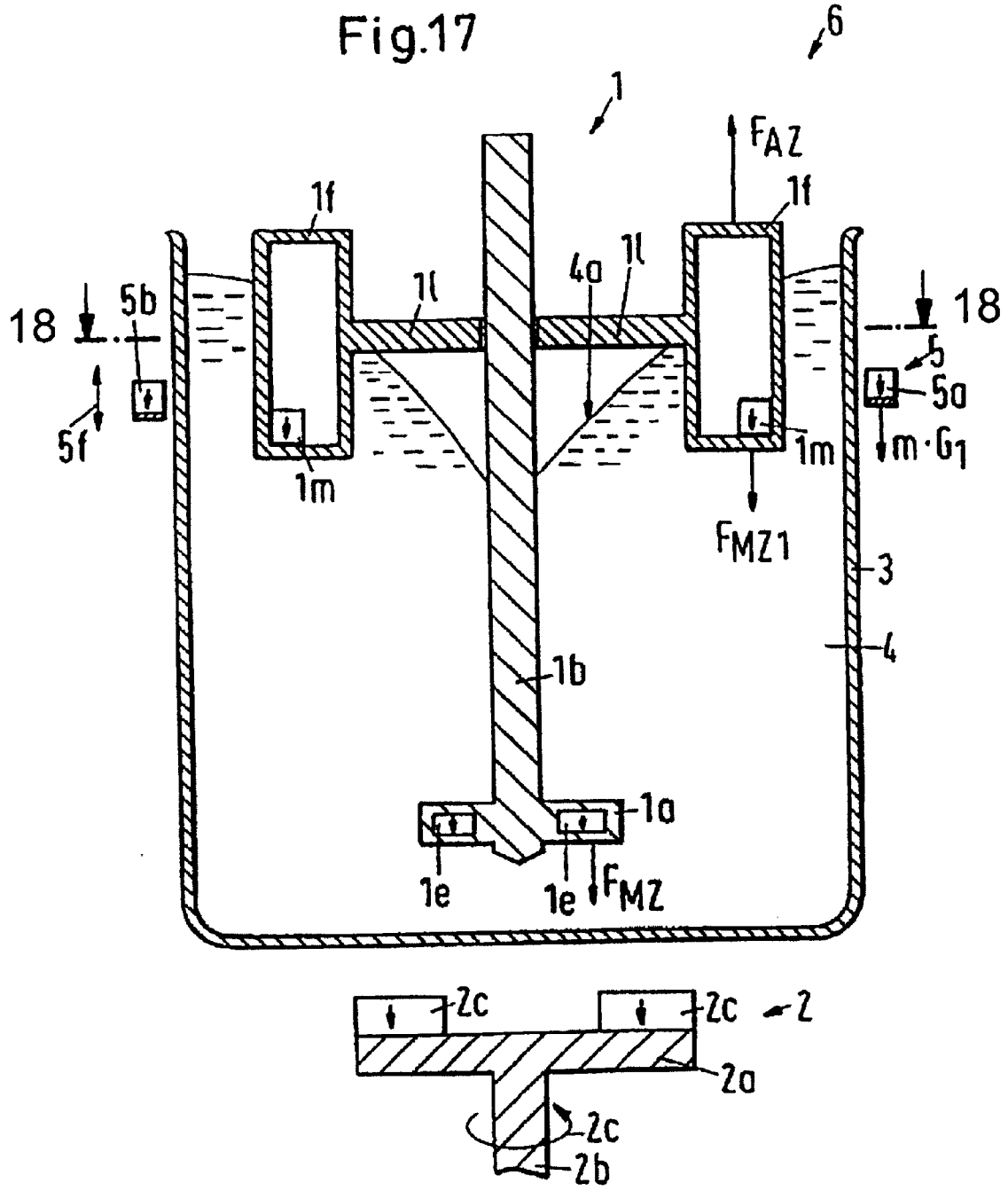
FIG. 17 is a longitudinal section through a further agitating device having a magnetic stirring apparatus.

In distinction to the agitating device 6 shown in FIG. 2, the magnetic stirring apparatus 1 shown in FIG. 17 has a float 1*f* with an annular design which is connected to the bar 1*b* via a connecting means 1*l*. The arrangement and design of the float body 1*f* is selected such that the liquid level 4*a* changing during stirring does not have any effect, or only a slight effect, on the level of the magnetic stirring device 1. The liquid shows the surface behavior designated by 4*a* due to the stirring of the liquid.

The magnetic stirring apparatus 1 has a relatively great mass and is therefore possibly difficult to hold in a radial direction by the drive device 2. The float 1*f* is therefore advantageously stabilized with an additional device. For this purpose, permanent magnets 1*m* are arranged in the float body 1*f* which extend in the peripheral direction. Moreover, an adjustment device 5 movable in the direction of displacement 5*f* is arranged outside the container 3 and has permanent magnets 5*a*, 5*b* arranged spread in the peripheral direction. The permanent magnets 5*a*, 5*b* are arranged with respect to the permanent magnets 1*m* such that the vertical position of the magnetic stirring apparatus 1 is also adjustable by a corresponding displacement of the adjustment device 5 in a vertical direction 5*f*. It is therefore advantageous for the radial position of the float body 1*f* to be additionally stabilized by the passive radial magnetic bearings formed by the permanent magnets 1*m*, 5*a*, 5*b*.

Figure 18:
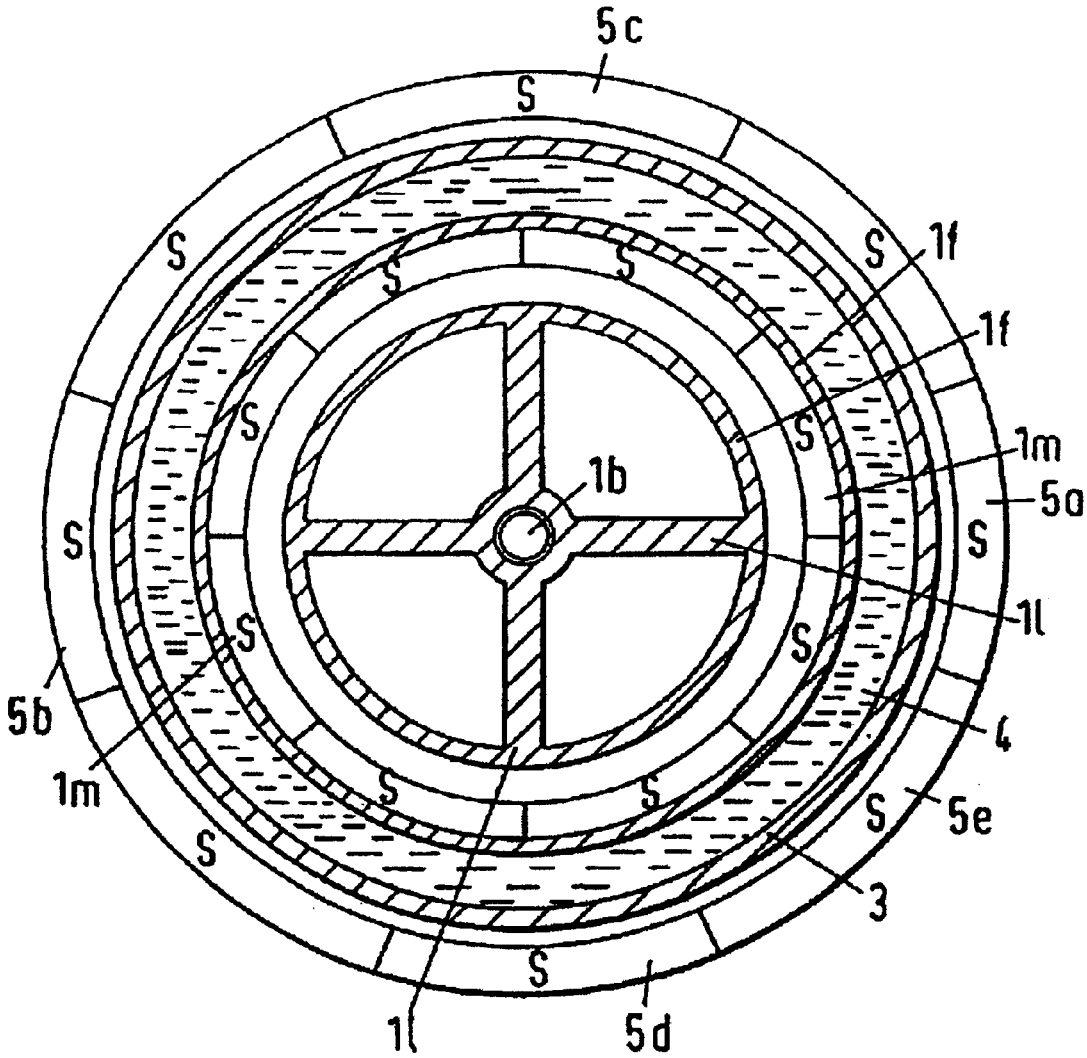
FIG. 18 is a cross-section through the agitating device shown in FIG. 17, along the intersection line 18—18.

The section along the line 18—18 of FIG. 17 shows in FIG. 18 showns the container wall 3 and the adjustment device 5 arranged outside the container 3 having supports 5*e* on which the permanent magnets 5*a*, 5*b*, 5*c*, 5*d* are arranged adjustably in the direction of displacement 5*f*. A plurality of permanent magnets 1*m* is arranged inside the hollow space of the float body 1*f* and extend in the peripheral direction.

Figure 19:
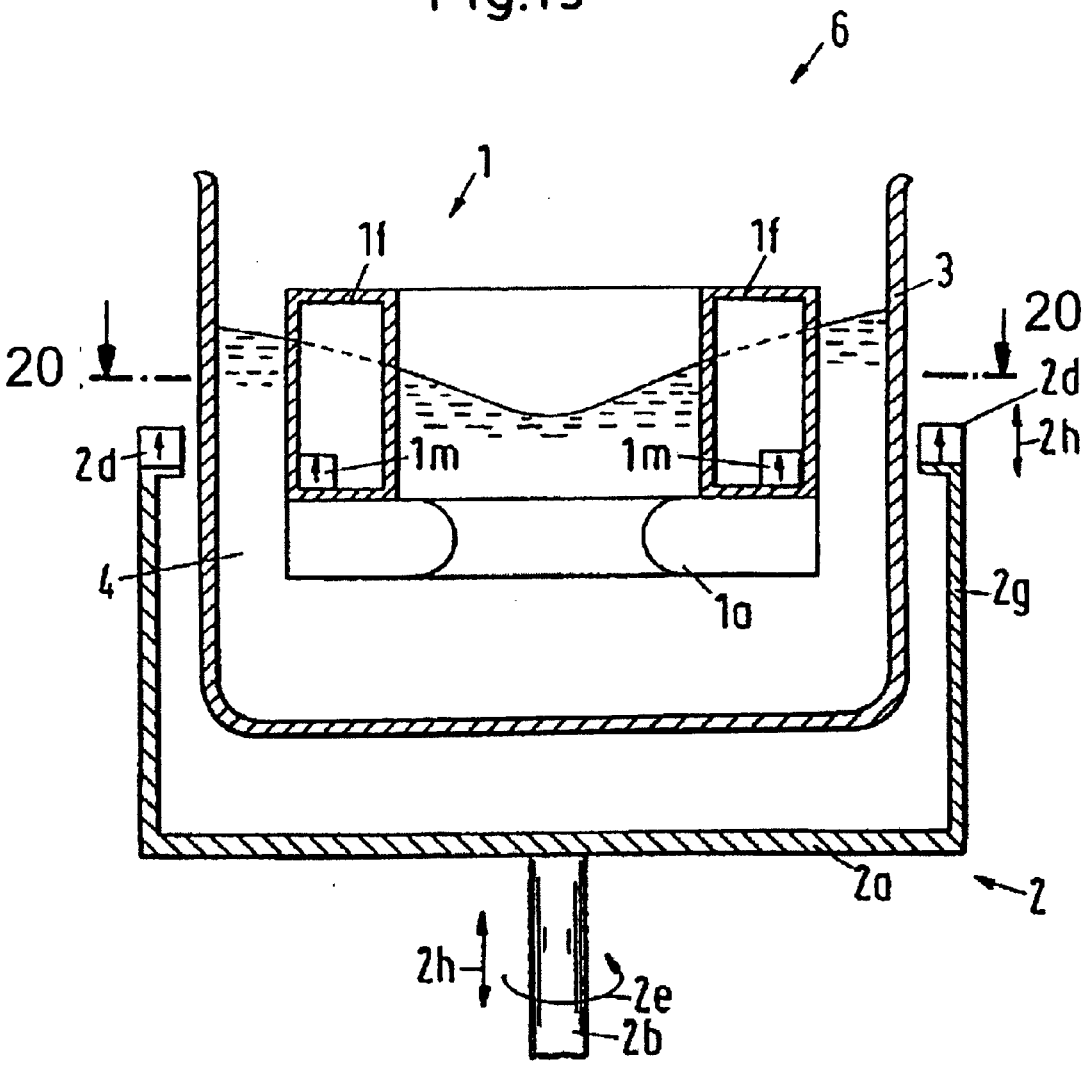
FIG. 19 is a longitudinal section through a further agitating device having a magnetic stirring apparatus.

The agitating device 6 shown in FIG. 19 in a longitudinal section has a magnetic stirring apparatus 1 which has a circular annular-shaped agitator 1*a* which is fixedly connected to a hollow cylinder-shaped float body 1*f*. Permanent magnets 1*m* spread in the peripheral direction are arranged inside the float body 1*f*. The drive device 2 has a cylinder-shaped part 2*g* which is fixedly connected to the axle 2*b*. Permanent magnets 2*d* extending in the peripheral direction are arranged at the end section of the part 2*g* such that the magnetic stirring apparatus 1 can be set into rotation in the direction of rotation 1*e* via the interaction occurring between the permanent magnets 2*d* and 1*m*. Moreover, the drive device 2 is journalled in a displaceable manner in the direction 2*h*, whereby the vertical position of the magnetic stirring device 1 can also be influenced. This radial coupling has the advantage that it only exerts a slight destabilizing force on the magnetic stirring device 1, with a simultaneously good stabilization in the radial direction.

Figure 20:
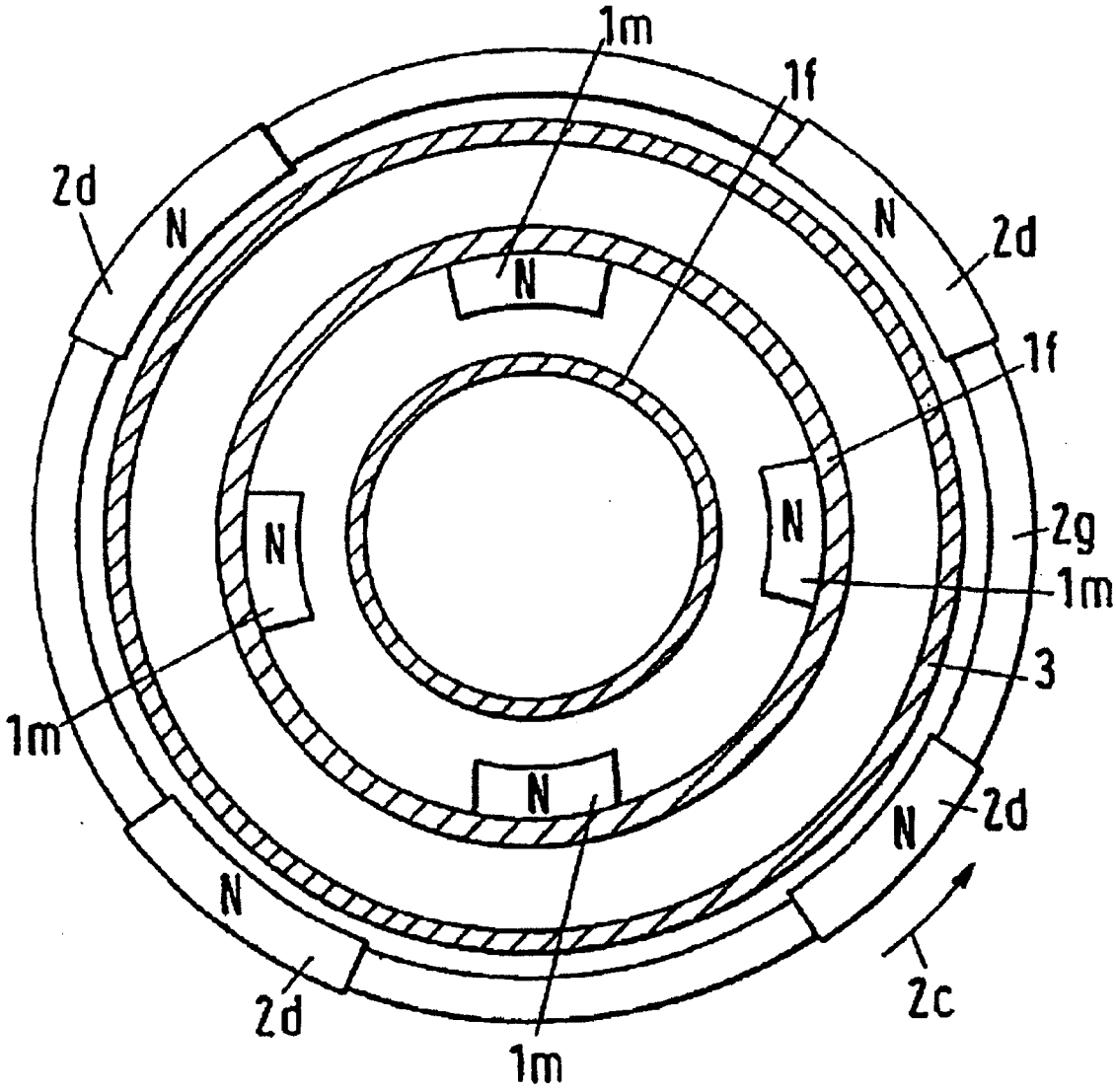
FIG. 20 is a cross-section through the agitating device shown in FIG. 19, along the intersection line 20—20.

FIG. 20 shows the flow body 1*f* in cross-section along the sectional line 20—20 of FIG. 19, with four permanent magnets 1*m* spread in the peripheral direction being arranged inside said flow body 1*f*. The cylinder-shaped part 2*g* of the drive device 2 is arranged outside the container 3, with four permanent magnets 2*d* also being arranged spread in the peripheral direction at part 2*g* such that a magnetic coupling is formed between the permanent magnets 1*m* of the float body 1*f* and the permanent magnet 2*d* of the drive device 2.

Figure 21:
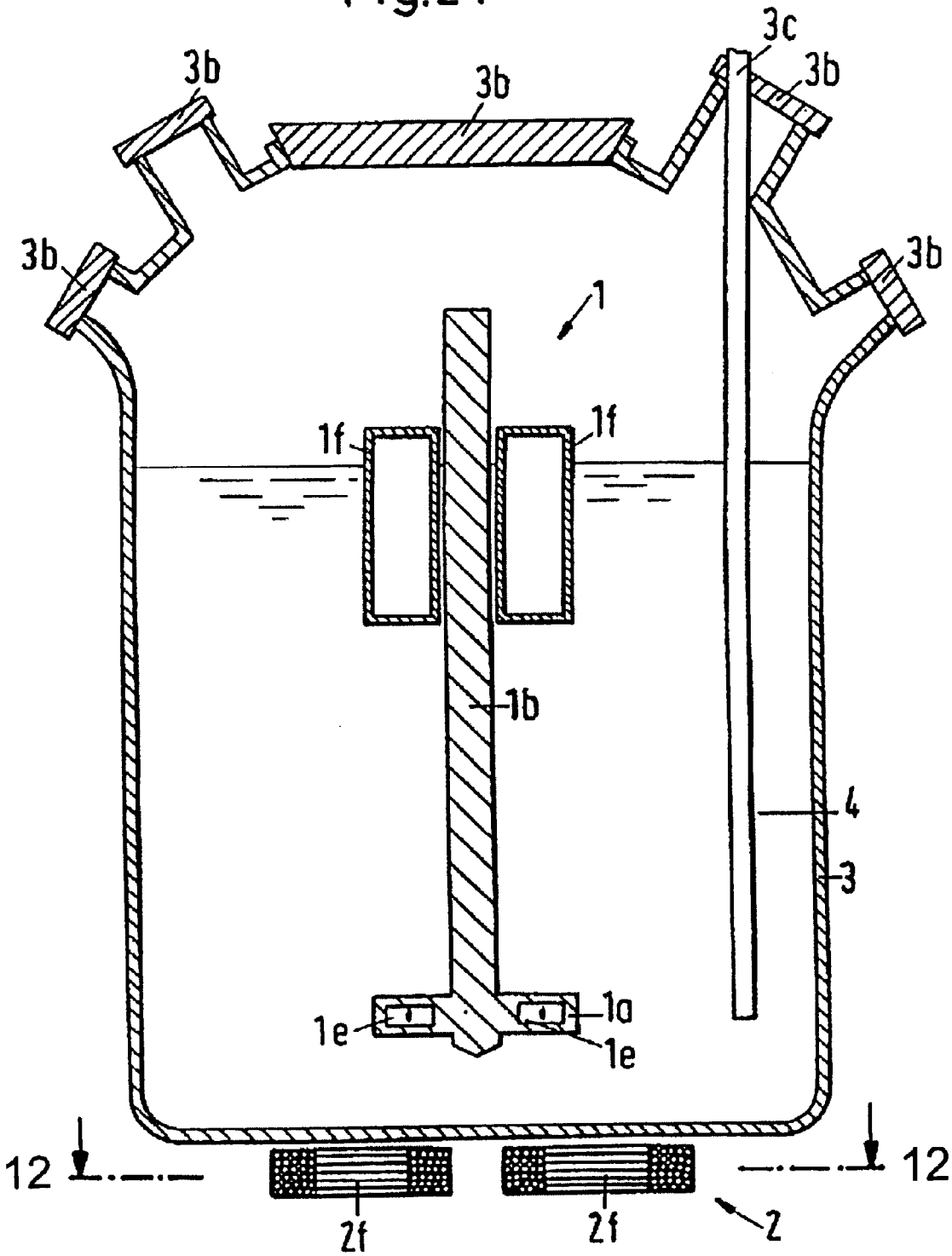
FIG. 21 shows an agitating device in combination with a bio-reactor.

The container 3 can, as indicated in FIG. 21, be designed as a closed bio-reactor provided with closable openings 3*b* and with feedlines and drain lines 3*c*.

The float body 1*f* could also be fixedly and unreleasably connected to the bar 1*b*. A set of magnetic stirring apparatuses 1 could also be provided, with the float body 1*f* being arranged at a different position on the bar 1*b* for each magnetic stirring apparatus 1 so that a suitable magnetic stirring apparatus 1 can be selected depending on the liquid level in the container 3.

What is claimed is:

1. A magnetic stirring apparatus comprising:

an agitator, at least one permanent magnet;

a float body; and a bar having an upper end, a lower end, an upper end section, and a lower end section, the bar tapering into a tip at the lower end, the agitator being arranged at the lower end section of the bar, the float body being arranged at the upper end section, and the at least one permanent magnet being connected to the agitator.

2. A magnetic stirring apparatus in accordance with claim 1 wherein:

the agitator is formed symmetrically; and, at least two permanent magnets are symmetrically arranged in the agitator.

3. A magnetic stirring apparatus in accordance with claim 1 wherein:

the float body has an increasing inner cross-section at least along one part section in the direction of the upper end section.

4. A magnetic stirring apparatus in accordance with claim 1 wherein:

at least one vane is arranged at the bar.

5. A magnetic stirring apparatus in accordance with claim 1 wherein:

a permanent magnet is arranged in the float body.

6. A magnetic stirring apparatus in accordance with claim 1 wherein:

the float body is formed in an annular shape.

7. A magnetic stirring apparatus in accordance with claim 1 wherein:

the agitator is made in a shape selected from the group consisting of a bar shape, a star shape and a circular shape.

8. A magnetic stirring apparatus in accordance with claim 1, and further including:

a magnetic drive apparatus, said magnetic drive apparatus and said at least one permanent magnet of the magnetic stirring apparatus forming a magnetic coupling for rotating the magnetic stirring apparatus.

9. A magnetic stirring apparatus in accordance with claim 8, wherein:

the drive apparatus has at least one permanent magnet which form a magnetic coupling together with the at least one permanent magnet of the magnetic stirring apparatus.

10. A magnetic stirring apparatus in accordance with claim 9, wherein:

the at least one permanent magnet of the magnetic stirring apparatus and the at least one permanent magnet of the drive apparatus are arranged and formed such that they mutually form a passive radial and/or axial magnetic bearing.

11. A magnetic stirring apparatus in accordance with claim 8, wherein:

the drive apparatus has a plurality of electromagnetic coils which form an electric motor together with the at least one permanent magnets magnet of the magnetic stirring apparatus.

12. A magnetic stirring apparatus in accordance with claim 8, wherein:

the magnetic stirring apparatus has a toe bearing.

13. A magnetic stirring apparatus in accordance with claim 8, wherein:

the magnetic stirring apparatus is a bio-reactor.

* * * * *